US008070891B2

(12) United States Patent
Fleury et al.

(10) Patent No.: US 8,070,891 B2
(45) Date of Patent: Dec. 6, 2011

(54) AMORPHOUS ALLOY AND MANUFACTURING METHOD THEREOF

(75) Inventors: Eric Fleury, Seoul (KR); Jayaraj Jayamani, Seoul (KR); Ki-bae Kim, Seoul (KR); Mee-soon Lee, legal representative, Seoul (KR); Hyun-kwang Seok, Seoul (KR); Yu-chan Kim, Seoul (KR); Kwang-youn Kim, Seoul (KR); Dohyang Kim, Seoul (KR)

(73) Assignee: Korea Institute of Science and Technology, Hawolgok-dong, Seongbuk-gu, Seoul (KR)

( * ) Notice: Subject to any disclaimer, the term of this patent is extended or adjusted under 35 U.S.C. 154(b) by 785 days.

(21) Appl. No.: 12/066,124

(22) PCT Filed: Dec. 30, 2005

(86) PCT No.: PCT/KR2005/004678
§ 371 (c)(1),
(2), (4) Date: Aug. 12, 2008

(87) PCT Pub. No.: WO2007/029906
PCT Pub. Date: Mar. 15, 2007

(65) Prior Publication Data

US 2010/0147422 A1 Jun. 17, 2010

(30) Foreign Application Priority Data

Sep. 9, 2005 (KR) ..... 10-2005-0084067

(51) Int. Cl.
*C22C 45/02* (2006.01)
*C22C 38/36* (2006.01)

(52) U.S. Cl. ..... 148/403; 148/324; 420/12

(58) Field of Classification Search ..... 148/324, 148/403, 561, 605, 607; 420/12
See application file for complete search history.

(56) References Cited

U.S. PATENT DOCUMENTS

| | | | |
|---|---|---|---|
| 4,318,738 | A | 3/1982 | Masumoto et al. |
| 4,623,408 | A | 11/1986 | Karamon et al. |

FOREIGN PATENT DOCUMENTS

| | | | |
|---|---|---|---|
| JP | 2000-345309 | | 12/2000 |
| JP | 2001-049407 | | 2/2001 |
| KR | 10-2005-0013796 | * | 2/2005 |
| KR | 10 2005 0013796 | | 2/2005 |
| WO | WO 2005-024075 A2 | * | 3/2005 |

OTHER PUBLICATIONS

J. Jayaraj et al. Corrosion studies on Fe-based amorphous alloys in simulated PEM fuel cell environment, Science and Technology of Advanced Materials, vol. 6, (2005), pp. 282-289.*

J. Jayaraj et al., Corrosion Studies on Fe-Based Amorphous Alloys in Simulated PEM Fuel Cell Environment, Science and Technology of Advanced Materials, 6 (2005), pp. 282-289.

* cited by examiner

*Primary Examiner* — George Wyszomierski
*Assistant Examiner* — Mark L Shevin
(74) *Attorney, Agent, or Firm* — Lexyoume IP Group, PLLC.

(57) ABSTRACT

The present invention relates to an amorphous alloy and a method for manufacturing thereof. The amorphous alloy according to the present invention includes has a chemical formula of Feioo-a-b-c-d-e-f-gCraMobCcBaYeMflg. Here, the M is at least one selected from a group consisting of Al, Co, N1 and Ni, and the I is at least one selected from a group consisting of Mn, P, S, and O as impurities. The a, b, c, d, e, f, and g are satisfied with the compositions of 16.0 wt %≦a<22.0 wt %, 15.0 wt %<b≦27.0 wt %, 2.0 wt %≦c<3.5 wt %, 1.0 wt %<d≦1.5 wt %, 1.0 wt %<e≦3.5 wt %, 0.25 wt %<f≦3.0 wt %, and 0.01 wt %≦g<0.5 wt %, respectively.

6 Claims, 14 Drawing Sheets

(A)

(B)

AMORPHOUS ALLOY AND MANUFACTURING METHOD THEREOF

BACKGROUND OF THE INVENTION (a) Field of the Invention

The present invention relates to an amorphous alloy and a manufacturing method there of, and more specifically to an amorphous alloy with good strength and high corrosion resistance and a manufacturing method thereof.

(b) Description of the Related Art

A fuel cell has been spotlighted as an alternative energy source due to global warming, pollution, and depletion of oil resources. The fuel cell is an electric generator. In the fuel cell, reactants continuously flow into the system while products are continuously discharged from the system. At the same time, electric energy is generated. That is, oxygen and hydrogen are continuously supplied to the fuel cell and a chemical reaction occurs, thereby generating electrical energy.

Various types of fuel cells have been developed. The fuel cells can be classified as high temperature fuel cells and low temperature fuel cells depending on electrolytes in a unit cell and operational temperature. The high temperature fuel cells include molten carbonate fuel cells, solid oxide fuel cells, and so on. The low temperature fuel cells include phosphoric acid fuel cells, polymer electrolyte fuel cells, alkaline fuel cells, and so on.

In particular, a polymer electrolyte membrane fuel cell (hereinafter referred to as a "PEMFC"), one of the solid polymer electrolyte fuel cells (hereinafter referred to as a "SPEFC") that is a low temperature fuel cell, is compact and light-weight, and has an advantage to be capable of operating at a low temperature. The PEMFC generates electric power from hydrogen and oxygen through a polymer membrane consisting of a membrane electrode assembly (hereinafter referred to as an "MEA"). The MEA is made by combining the polymer membrane with electrodes located on each side thereof.

Each electrode support is made of carbon cloth supporting electrode materials such as carbon black including platinum catalysts. A plurality of the MEAs with a thickness of several tens to several hundreds of micrometers are filled between multi-functional bipolar plates in order to obtain sufficient electric power. Therefore, several tens to several hundreds of unit cells are serially connected to each other and form a fuel cell stack.

The bipolar plates of the PEMFC are exposed to severe operating conditions in which current and stress are applied and corrosion occurs. Therefore, materials for the bipolar plates are required to have properties of gas impermeability, high strength, corrosion resistance, and good electrical conductivity. Currently used bipolar plates mainly made of a carbon do not have such properties. In particular, thin metallic bipolar plates with high strength and low cost are required since bulk graphite bipolar plates are weak.

Therefore, research relating to bipolar plates made of graphite composites and stainless steels as a replacing material of the bipolar plates has been undertaken. In addition, as a method of manufacturing bipolar plates, research relating to a thermal nitriding surface treatment, TiN coating on stainless steel, thin PVD (physical vapor deposition) coatings, etc., has been pursued.

However, there is a problem in that metallic ions are dissolved and the MEA is poisoned if the electrons are lost in the bipolar plates. Furthermore, metallic oxides grow in a cathode since the metallic bipolar plates obtain electrons and then a recovery reaction occurs. Therefore, there is a problem in that electrical resistance of the surface increases while performance of the fuel cell is deteriorated. Materials with high strength and corrosion resistance have been seriously required in other circumstances in addition to materials for the fuel cells.

SUMMARY OF THE INVENTION

This present invention is contrived to solve the aforementioned problems, and provides an amorphous alloy with high strength and good corrosion resistance.

In addition, the present invention provides a method for manufacturing the aforementioned amorphous alloy.

An amorphous alloy according to the present invention has a chemical formula of $Fe_{100-a-b-c-d-e-f-g}Cr_aMo_bC_cB_dY_eM_fI_g$. The M is at least one selected from a group consisting of Al, Co, N, and Ni, the I is at least one selected from a group consisting of Mn, P, S, and O as impurities, and the a, b, c, d, e, f, and g are satisfied with the compositions of 16.0 wt %≦a≦22.0 wt %, 15.0 wt %≦b≦27.0 wt %, 2.0 wt %≦c≦3.5 wt %, 1.0 wt %≦d≦1.5 wt %, 1.0 wt %≦e≦3.5 wt %, 0.25 wt %≦f≦3.0 wt %, and 0.01 wt %≦g≦0.5 wt %, respectively.

It is preferable that the above amorphous alloy according to the present invention includes N in a range from 0.4 wt % to 1.0 wt %.

The N may be substantially 0.8 wt %.

An oxide film may be formed on a surface of the amorphous alloy, and the oxide film may include the N.

It is preferable that Vickers microhardness of the amorphous alloy is 1000 kgf/mm$^2$ or more, and that strength of the amorphous alloy is in a range from 2500 MPa to 4000 MPa.

It is preferable that a wetting angle of the amorphous alloy is in a range from 80° to 100°.

It is preferable that the amorphous alloy is used as a material for a bipolar plate of a fuel cell.

Another amorphous alloy according to the present invention has a chemical formula of $Ni_{100-a-b-c-d-e-f}Nb_aZr_bTi_cTa_dM_eI_f$. Here, the M is at least one selected from a group of Sn and Si, the I is at least one selected from a group of C and O, and the a, b, c, d, e, and f are satisfied with the compositions of 10.0 wt %≦a≦25.0 wt %, 5.0 wt %≦b≦25.0 wt %, 5.0 wt %≦c≦10.0 wt %, 0.0 wt %<d≦25.0 wt %, 0.0 wt %<e≦6.5 wt %, 0.01 wt %≦f≦0.5 wt %, respectively.

A method for manufacturing the amorphous alloy according to the present invention is a method of manufacturing the amorphous alloy having the above composition. The method for manufacturing the amorphous alloy according to the present invention includes steps of manufacturing a mixture in which each of elements are mixed together to have a composition having a chemical formula of $Fe_{100-a-b-c-d-e-f-g}Cr_aMo_bC_cB_dY_eM_fI_g$, arc melting the mixture at a temperature of 3000° C. or more, manufacturing the amorphous alloy by suction casting the melted mixture, processing a luster finish on a surface of the amorphous alloy, and annealing the amorphous alloy for 5 to 15 minutes.

It is preferable that the glass transition temperature ($T_g$) of the amorphous alloy is in the range from 550° C. to 610° C. in the manufacturing of the amorphous alloy by suction casting the melted mixture.

The amorphous alloy may be annealed at a temperature of 0.6 $T_g$ to 0.8 $T_g$ in the annealing of the amorphous alloy for 5 to 15 minutes.

Another method for manufacturing the amorphous alloy according to the present invention is a method for manufacturing the amorphous alloy having the above composition.

The method for manufacturing the amorphous alloy according to the present invention includes steps of manufacturing a mixture in which each of elements are mixed together to have a composition having a chemical formula of $Ni_{100-a-b-c-d-e-f}Nb_aZr_bTi_cTa_dM_eI_f$, arc melting the mixture at a temperature of 3000° C. or more, manufacturing the amorphous alloy by suction casting the melted mixture, processing a luster finish on a surface of amorphous alloy, and annealing the amorphous alloy for 5 to 15 minutes.

ADVANTAGEOUS EFFECTS

Since the Fe-based and Ni-based amorphous alloys according to the present invention have high strength and good corrosion resistance, they are suitable for being used as a bipolar plate.

DETAILED DESCRIPTION OF THE INVENTION

Figure 1:
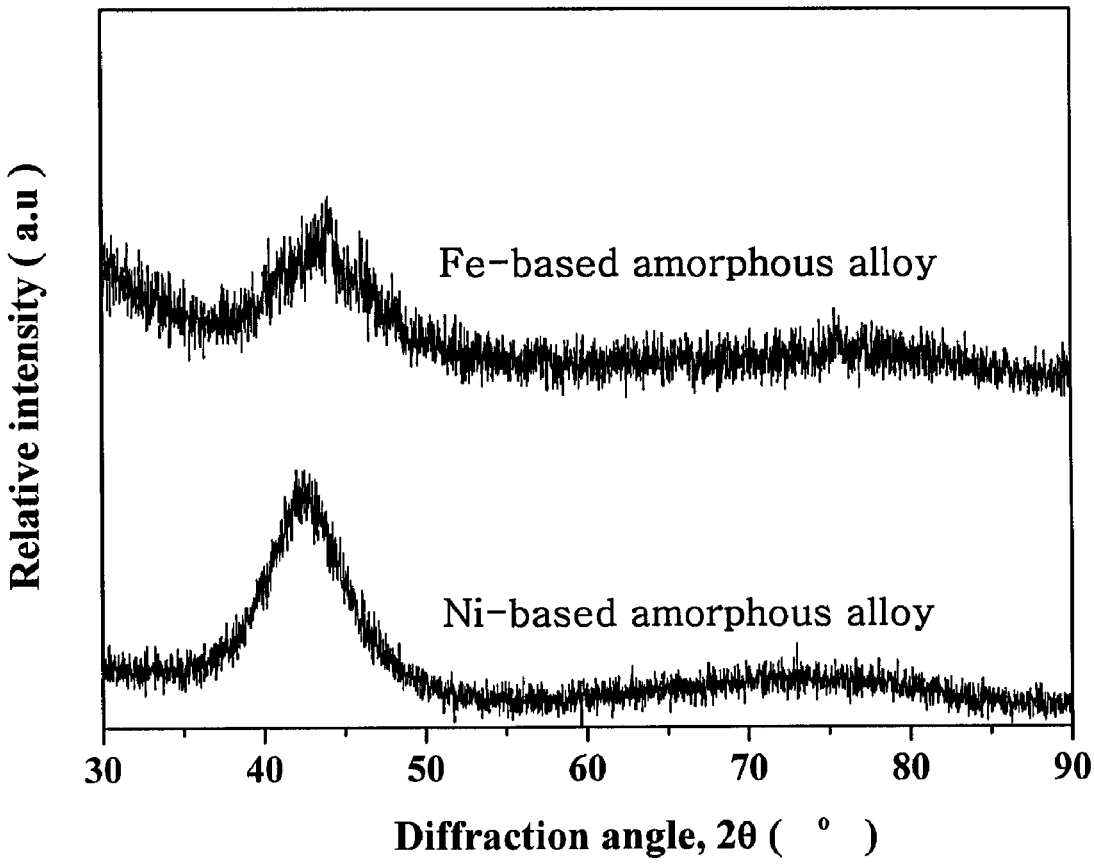
FIG. 1 is an XRD graph of the Fe-based and Ni-based amorphous alloys.

Hereinafter, embodiments of the present invention will be described with reference to the attached drawings. The embodiments are merely to illustrate the present invention and the present invention is not limited thereto.

An amorphous alloy according to the present invention can be applied to a bipolar plate of fuel cells and so on. Hereinafter, although the amorphous alloy is mainly explained by using it as a material for the bipolar plate, this is merely to explain a use of the amorphous alloy, and the present invention is not limited thereto. Therefore, the amorphous alloy according to the present invention can be used in an environment which requires high strength and good corrosion resistance.

Since the amorphous alloy has very slow crystal nucleation rate and growth rate, it can be supercooled at a temperature that is much lower than its melting point. Since a supercooled liquid has a high viscosity, the atoms are not rearranged to form a crystal but maintain irregular arrangement to form an amorphous phase. Therefore, the amorphous alloy has a high forming ability at a supercooled liquid region. In addition, since the amorphous alloy has properties of high strength, high hardness, soft magnetism, good wear resistance, good corrosion resistance and so on, it is suitable to be applied to the bipolar plate, etc.

In contrast with the amorphous alloy, a general alloy is quickly crystallized at a temperature that is directly below melting point when it is cooled in a liquid phase. In this case, most of the alloys do not form single crystals, but form a polycrystals that have various shapes and sizes.

In addition, the amorphous alloy has a high elastic deforming ability. A stress and strain rate of the amorphous alloy has a linear relationship with a slope of a range from 0.9 to 1.0. The slope is much greater than that of a general alloy, which is 0.3. This means that the amorphous alloy has ideal forming ability even at an under-cooled liquid phase where a deformation rate is high. The amorphous alloy is easily deformed at a relatively low temperature even by a low stress in comparison to a general alloy.

In particular, when the amorphous alloy is used in the bipolar plate, it is easy to form gas channels for circulating hydrogen, oxygen, and water on the amorphous alloys at a supercooled liquid phase. The gas channels can be formed by a micropore forming method at a temperature between a glass transition temperature ($T_g$) and a crystallization temperature ($T_x$).

In a PEMFC, water is generated by a mixing reaction between hydrogen and oxygen. Hydrogen cations are generated at an anode while oxygen electrons are generated at a cathode. Electrons exit from hydrogen atoms generate electric power, while the hydrogen cations pass through a polymer electrolyte membrane and are combined with oxygen electrons to generate water molecules.

The polymer electrolyte membrane is usually made of perfluorinated sulfonic acid containing sulfur and fluorine. In addition, S and F ions are removed from an electrode, forming a solution similar to that of $H_2SO_4$+2 ppm $F^-$. Reaction temperature is limited to about 80° C. in the PEMFC in order to prevent vapor from being generated. In the bipolar plate, one side thereof is exposed to hydrogen gas with a potential of −0.1V while the other side thereof is exposed to oxygen gas with a potential of 0.6V. Therefore, in spite of some variables, polymer electrolyte membrane fuel cells operate under a condition in which a relatively constant potential is maintained with a value of about −0.1V and 0.6V at the anode and cathode, respectively.

A method for manufacturing the amorphous alloy will be explained below.

First, elements that have desired compositions are mixed together. For example, in a case of an Fe-based amorphous alloy, each element is mixed to make a chemical composition of the Fe-based amorphous alloy to be $Fe_{100-a-b-c-d-e-f-g}Cr_aMo_bC_cB_dY_eM_fI_g$. Here, the M is at least one selected from a group consisting of Al, Co, N, and Ni, and the I is at least one selected from a group consisting of Mn, P, S, and O as impurities. The a, b, c, d, e, f, and g are satisfied with the compositions of 16.0 wt %≦a≦22.0 wt %, 15.0 wt %≦b≦27.0 wt %, 2.0 wt %≦c≦3.5 wt %, 1.0 wt %≦d≦1.5 wt %, 1.0 wt %≦e≦3.5 wt %, 0.25 wt %≦f≦3.0 wt %, and 0.01 wt %≦g≦0.5 wt %, respectively. In addition, in a case of the Ni-based amorphous alloy, each element is mixed to make a chemical composition of the Ni-based amorphous alloy to be $Ni_{100-a-b-c-d-e-f}Nb_aZr_bTi_cTa_dM_eI_f$. Here, the M is at least one selected from a group consisting of Sn and Si, and the I is at least one selected from a group consisting of C and O. The a, b, c, d, e, and f are satisfied with the compositions of 10.0 wt %≦a≦25.0 wt %, 5.0 wt %≦b≦25.0 wt %, 5.0 wt %≦c≦10.0 wt %, 0.0 wt %<d≦25.0 wt %, 0.0 wt %<e≦6.5 wt %, 0.01 wt %≦f≦0.5 wt %.

Next, a plate-shaped Fe-based bulk amorphous alloy or a Ni-based bulk amorphous alloy is manufactured by suction casting the above mixtures using a suction casting method. More specifically, after the mixtures are arc melted at 3000° C. or more, they are suctioned by using a vacuum pump while being kept in an arc melting mold by surface tension. Then, a plate-shaped sample with a width of 5-8 mm and a length of 5-10 mm is manufactured by filling the mixture in a copper mold. The suction molding method is used in order to obtain an amorphous alloy with a desired shape.

The amorphous alloy according to the present invention may be manufactured by using a rapid solidification method in addition to the aforementioned suction molding. It is possible to use plane casting or die casting methods considering quality and shape of the manufactured products.

Luster finishing is applied to a surface of the amorphous alloy manufactured by the aforementioned method so that surface roughness is lowered and microporosity is not generated. Next, the bipolar plate is annealed at a temperature of about 0.6 $T_g$ to 0.8 $T_g$ for about 5 to 15 minutes in order to release residual stresses.

Among the amorphous alloys, Fe-based and Ni-based amorphous alloys are the same as stainless steel in terms of electrical resistance. However, strength and corrosion resistance of the amorphous alloys are three times or more those of the stainless steel. Therefore, if the bipolar plate is made of the amorphous alloys, electric power generation efficiency is not reduced even if the fuel cell is used for a long time. In particular, since the Fe-based amorphous alloys are not only inexpensive but also have low contact resistance and high corrosion resistance, it is suitable for the bipolar plate. On the other hand, since the Fe-based amorphous alloy is a soft magnetic material, the Fe-based amorphous alloy may be used for a transformer, a magnetic head, etc.

Considering corrosion characteristics of a metallic alloy, an oxide film, which is referred to as a passive film, is formed on a surface of the alloy. The oxide film increases contact resistance that is required in the bipolar plate. Therefore, it is necessary to not increase contact resistance by forming the oxide film as thin as possible. The oxide film formed on the bipolar plate is thinner than that formed on a bipolar plate made of a stainless steel. Therefore, the oxide film formed on the bipolar plate has high corrosion resistance and low contact resistance.

Since the amorphous alloy according to the present invention includes a predetermined amount of N, corrosion resistance thereof is greatly improved. Therefore, it is better to use the amorphous alloy as a material of the bipolar plate. The N significantly influences the corrosion resistance under an HCl solution and an $H_2SO_4$ solution which is similar to the environment of the fuel cell.

In particular, the N improves the corrosion resistance of the amorphous alloy in a solution including Cl. The N significantly influences the corrosion resistance under an HCl solution and an $H_2SO_4$ solution. If an amount of N is 0.1 wt % or more, the corrosion resistance of an alloy increases. If an amount of N is 0.2 wt % or less, although the alloy has an amorphous structure, it is difficult to manufacture ingots since the N is easily vaporized. Therefore, it is preferable that the content of the N is controlled in a range from 0.4 wt % to 1.0 wt %, and it is more preferable that the content of N is maintained at 0.8 wt %.

As described above, a bipolar plate, which is suitable for a peripheral environment of the fuel cell, can be manufactured by adding a suitable amount of N. When the bipolar plate is manufactured by using the amorphous alloy including the aforementioned amount of N, performance of the fuel cell is good since the bipolar plate has good corrosion resistance.

Especially, if both Mo and N are added to the Fe-based amorphous alloy according to the present invention, synergetic effects in the corrosion resistance and glass forming ability occur. Therefore, it is preferable that both Mo and N are added.

Since the Fe-based amorphous alloy according to the present invention includes both Cr and Mo, it has good corrosion resistance. Considering a formation of the amorphous phase and corrosion resistance, it is preferable that the Fe-based amorphous alloy includes Cr at 16.0 wt % to 22.0 wt % and Mo at 15.0 wt % to 27.0 wt %. Cr contributes to improvement of the corrosion resistance and Mo contributes to improvement of formation of an amorphous phase. Composition ranges of Cr and Mo depend on a process reaction. The Fe-based amorphous alloy has a corrosion resistance that is better than that of the stainless steel in an HCl solution.

If the content of Cr included in the Fe-based amorphous alloys is less than 16.0 wt %, it is difficult to use it as the bipolar plate since its corrosion resistance is low. In addition, if the content of Cr is more than 22.0 wt %, it is difficult to form an amorphous phase.

If the content of Mo included in the Fe-based base amorphous alloy is less than 15.0 wt %, it is difficult to form an amorphous phase. Further, if the content of Mo is more than 27.0 wt %, corrosion resistance of the Fe-based amorphous alloy is reduced. In particular, considering both amorphous phase forming ability and corrosion resistance, it is most preferable that about 15 wt % of the Mo is added.

Under an environment of the fuel cell including 1M $H_2SO_4$+2 ppm $F^-$ at 80° C. with hydrogen bubbling and air bubbling, the Fe-based amorphous alloy including Al and N has good corrosion resistance. If the Fe-based amorphous alloy includes N at 2.0 wt % or less, its corrosion resistance is improved.

It is preferable that the Fe-based amorphous alloys include carbon at 2.0 wt % to 3.5 wt %. If the content of carbon is less than 2.0 wt % or greater than 3.5 wt %, it is difficult to form an amorphous phase.

It is preferable that the Fe-based amorphous alloy includes boron at 1.0 wt % to 1.5 wt %. If the content of boron is less than 1.0 wt % or greater than 1.5 wt %, it is difficult to form an amorphous phase since a supercooling region is narrowed.

It is preferable that the Fe-based amorphous alloy includes yttrium at 1.0 wt % to 3.5 wt %. If the content of yttrium is less than 1.0 wt % or greater than 3.5 wt %, the amorphous forming ability is reduced. Particularly, it is preferable that the Fe-based amorphous alloy includes rare earth metals such as yttrium (Y), gadolinium (Gd), dysprosium (Dy), etc., at an amount of 2 wt % to 3 wt % in order to improve amorphous forming ability of the bipolar plate by removing an oxygen effect. As a result, an amorphous phase has a plate shape with a thickness of 5 mm to 10 mm depending on the alloy composition. The bipolar plate may be easily manufactured by using the plate with the aforementioned thickness.

It is preferable that the Fe-based amorphous alloy includes at least one element selected from a group consisting of Al, Co, N, and Ni at 0.25 wt % to 3.0 wt %. If the at least one element selected from the group consisting of Al, Co, N, and Ni is present at less than 0.25 wt %, corrosion resistance is reduced. If it is greater than 3.0 wt %, it is difficult to form an amorphous phase.

In addition, it is preferable that the Fe-based amorphous alloy includes at least one element selected from a group consisting of Mn, P, S, and O at 0.01 wt % to 0.5 wt %. If the at least one element selected from the group consisting of Mn, P, S, and O is less than 0.01 wt % or greater than 0.5 wt %, it is difficult to form an amorphous phase.

Furthermore, in the present invention, the Ni-based amorphous alloy may be used in the bipolar plate. The Ni-based amorphous alloy has similar corrosion characteristics to those of the Fe-based amorphous alloys in corrosion current density of the fuel cell. However, the Ni-based amorphous alloy is superior to the Fe-based amorphous alloy in terms of passivation electric current. In addition, the Ni-based amorphous alloy has a supercooling region that is larger than that of the Fe-based amorphous alloy.

The Ni-based amorphous alloy has a large passivation region of up to 1.6V. Theoretically, combination of one hydrogen ion, two oxygen ions, and one electron generates an electric force of 1.23V. As the electric force increases, the potential of the fuel cell is reduced to 0.7V which is applied to the bipolar plate. However, if the fuel cell operates under a loaded power, the electric power is increased to a theoretical value of 1.23V. The value exceeds the potential of passivation areas of the Fe-based amorphous alloy and stainless steel (SS316L). However, the value is less than a potential of a passivation region of the Ni-based amorphous alloy. Therefore, the bipolar plate made of the Ni-based amorphous alloy has good corrosion resistance under an operating condition of the fuel cell having a large passivation area.

A $Ni_{59}Zr_{16}Ti_{13}Nb_7Sn_3Si_2$ alloy, a $Ni_{60}Nb_{20}Ti_{10}Zr_5Ta_5$ alloy, a $Ni_{59}Zr_{16}Ti_{13}Nb_7Sn_3Si_2$ alloy, and a $Ni_{60}Nb_{20}Ti_{10}Zr_5Ta_5$ alloy, etc., may be used as the Ni-based amorphous alloy.

Corrosion resistance of the Ni-based amorphous alloy depends on concentration of passivation elements such as Zr included in a $Ni_{59}Zr_{16}Ti_{13}Nb_7Sn_3Si_2$ alloy, Nb included in an $Ni_{60}Nb_{20}Ti_{10}Zr_5Ta_5$ alloy, Ti included in a $Ni_{59}Zr_{16}Ti_{13}Nb_7Sn_3Si_2$ alloy, Ti included in a $Ni_{60}Nb_{20}Ti_{10}Zr_5Ta_5$ alloy, etc. Concentrations of Nb oxide and Zr oxide on a surface of the Ni-based amorphous alloy are greater than those of Nb and Zr, respectively. Ti is distributed on a surface of the Ni-based amorphous alloy, and its concentration is similar to that of Ti concentration of the Ni-based amorphous alloy.

Since a concentration of the Ni is relatively low in the passive film, the Ni-based amorphous alloy can show good corrosion resistance under a condition that an oxide film including $Nb^-$ ions, $Zr^-$ ions, and $Ti^-$ ions are sufficiently formed.

The Ni-based amorphous alloy according to the present invention may include niobium at 10.0 wt % to 25.0 wt %. If the content of niobium is less than 10.0 wt % or greater than 25.0 wt %, it is difficult to form an amorphous phase.

In addition, the Ni-based amorphous alloy may include zirconium at 5.0 wt % to 25.0 wt %. If the amount of zirconium is less than 5.0 wt % or greater than 25.0 wt %, it is difficult to form an amorphous phase.

Furthermore, the Ni-based amorphous alloy may include titanium at 5.0 wt % to 10.0 wt %. If the amount of titanium is less than 5.0 wt % or greater than 10.0 wt %, it is difficult to form an amorphous phase.

The Ni-based amorphous alloy may include tantalum at 25.0 wt % or less. If the amount of tantalum is greater than 25.0 wt %, it is difficult to form an amorphous phase.

The Ni-based amorphous alloy may include at least one element selected from a group consisting of Sn and Si. If the amount of the at least one element selected from the group consisting of Sn and Si is greater than 6.5 wt %, it is difficult to form a bulk amorphous phase with a thickness of about 5 mm.

The Ni-based amorphous alloy may include at least one element selected from a group consisting of C and O. If the amount of the at least one element selected from the group consisting of C and O is less than 0.01 wt % or greater than 0.5 wt %, it is difficult to form an amorphous phase.

Ta or Ti as an early transition metal may be added to the Ni-based amorphous alloy. Ta may be added to the Ni-based amorphous alloy if the second element thereof is Nb while Ti may be added thereto if the second element thereof is Zr. Therefore, amorphous forming ability is improved a little.

X-ray diffraction analysis is conducted on the Fe-based amorphous alloy or the Ni-based amorphous alloy manufactured by the aforementioned method in order to determine whether they have a halo pattern, which is a unique pattern of the amorphous alloy. In addition, glass transition temperature ($T_g$) and crystallization peak temperature ($T_x$) are measured by using DSC (differential scanning calorimetry). Next, corrosion resistance, contact resistance, and strength of the bipolar plate are estimated.

Amorphous Structure

Amorphous structures of the Fe-based and Ni-based amorphous alloys are explained below.

FIG. 1 illustrates XRD traces of the Fe-based amorphous alloy whose chemical composition is $Fe_{43}Cr_{18}Mo_{14}C_{15}B_6Y_2Al_2$ and the Ni-based amorphous alloy whose chemical composition is $Ni_{59}Zr_{16}Ti_{13}Nb_7Sn_3Si$. As illustrated in the left side of FIG. 1, a halo peak appears in each of the Fe-based and Ni-based amorphous alloys. The halo peak means that the alloy has an amorphous phase when the alloys undergo rapid solidification.

Figure 2:
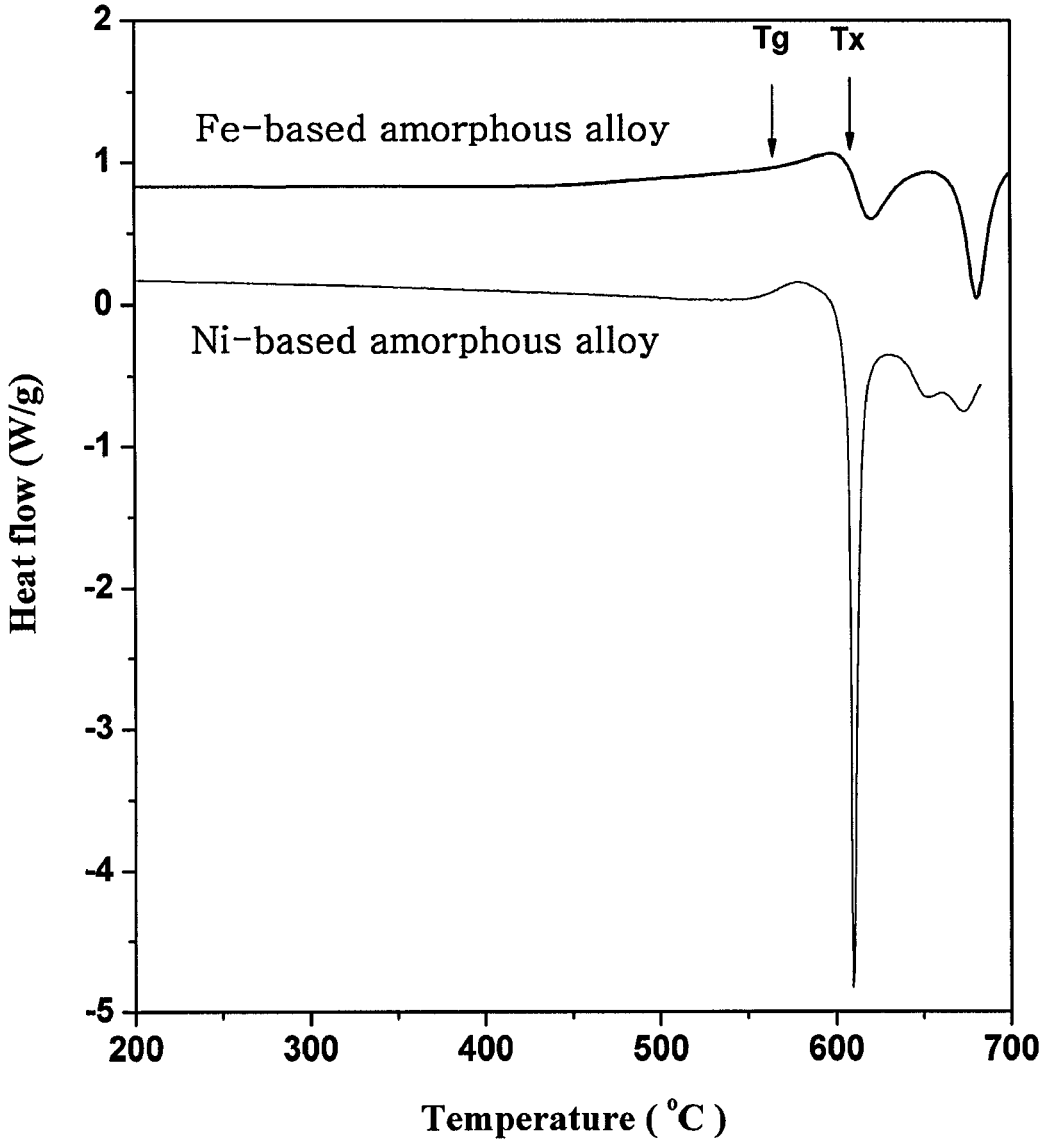
FIG. 2 shows DSC (differential scanning calorimetry) traces of the Fe-based and Ni-based amorphous alloys.

FIG. 2 illustrates DSC analysis curves of the Fe-based amorphous alloy whose chemical composition is $Fe_{50}Cr_{18}Mo_8Al_2C_{14}B_6Y_2$ and the Ni-based amorphous alloy whose chemical composition is $Ni_{59}Zr_{16}Ti_{13}Nb_7Sn_3Si_2$. The heating rate was 20° C./min. The glass transition temperature ($T_g$) and the crystallization peak temperature ($T_x$) of the $Fe_{50}Cr_{18}Mo_8Al_2C_{14}B_6Y_2$ alloy and the $Ni_{59}Zr_{16}Ti_{13}Nb_7Sn_3Si_2$ alloy can be measured from FIG. 1 by using the DSC analysis. The glass transition temperature of the $Fe_{50}Cr_{18}Mo_8Al_2C_{14}B_6Y_2$ alloy is 580° C. and crystallization peak temperatures thereof are 605° C. and 685° C. On the other hand, the glass transition temperature ($T_9$) of the $Ni_{59}Zr_{16}Ti_{13}Nb_7Sn_3Si_2$ alloy is 555° C. and the crystallization peak temperature ($T_x$) thereof is 607° C. Therefore, the glass transition temperature ($T_g$) of the above two alloys is in a range from 550° C. to 610° C., and the crystallization peak temperature ($T_x$) thereof is in a range from 600° C. to 700° C.

Consequently, if the amorphous alloy is used in the bipolar plate, because of the glass transition temperature ($T_g$) and crystallization peak temperature ($T_x$) of the amorphous alloy, it can be used without controlling a microstructure thereof.

Mechanical Properties

Amorphous materials have high microhardness and high strength. In particular, Vickers microhardness of the Fe-based and Ni-based amorphous alloys is 1000 kgf/mm$^2$ (10 GPa) or more and strength thereof is substantially 3000 MPa (3 GPa). The thickness of the bipolar plate can be greatly reduced if an amorphous material with a high strength is used therein, so weight and volume of the fuel cell can be significantly reduced. Therefore, amorphous materials with the aforementioned Vickers microhardness and strength are preferable for use in the bipolar plate.

Corrosion Resistance

Amorphous materials have good corrosion resistance. FIGS. 3 to 6 illustrate potentio-dynamic curves from which the corrosion resistance of the amorphous materials can be analyzed under conditions that are similar to those of the PEMFC. The process for measuring the potentio-dynamic is explained below.

Hydrogen bubbling or air bubbling is supplied under a 1M $H_2SO_4$+2 ppm $F^-$ environment at 75° C. and 80° C. in order to realize an environment of the anode and cathode, respectively. The materials form a layer until it reaches an equilibrium state during corrosion. When the layer is completely formed, the corrosion reaction is stopped. However, it is absolutely impossible to reach an equilibrium state in an environment where a reaction is active. In this case, an oxide layer is partly dissolved and then a new surface of the material is exposed. The dissolved oxide layer contaminates an aqueous solution with by-products, and the by-products reduce electrode efficiency, particularly in the PEMFC. Therefore, it is important to minimize contamination occurring in the materials used in the bipolar plate.

Figure 3:
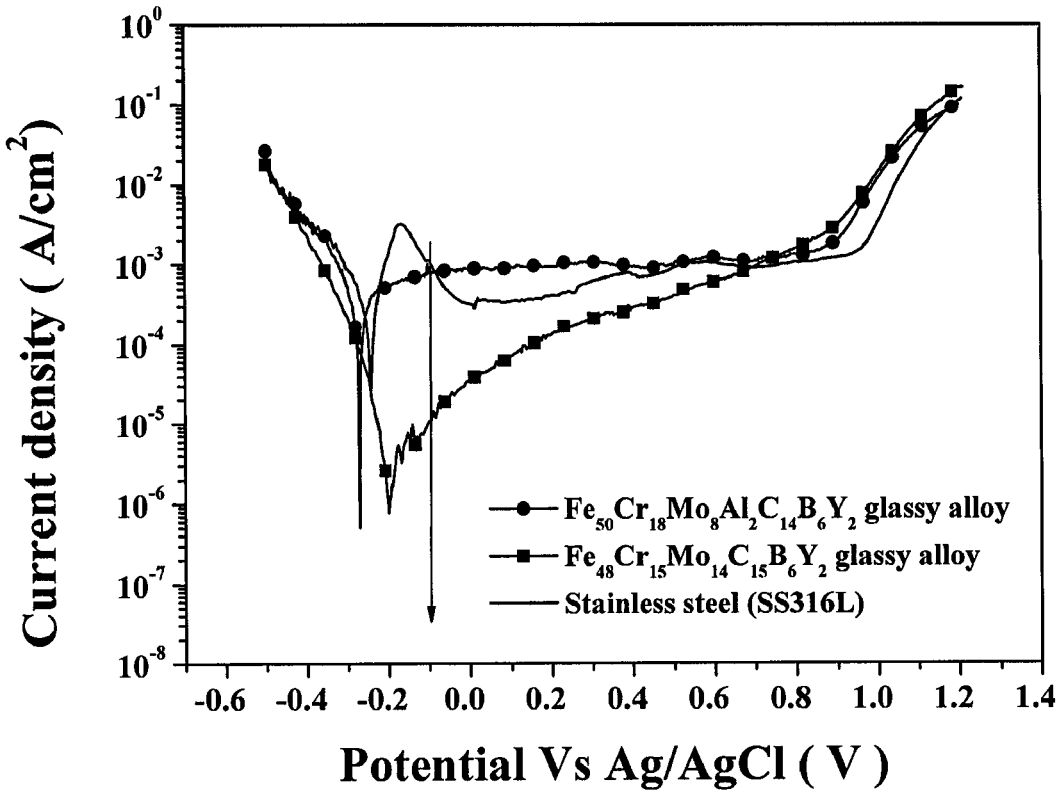
FIG. 3 is a potentio-dynamic graph measuring an $Fe_{50}Cr_{18}Mo_8C_{14}B_6Y_2Al_2$ alloy, a $Fe_{48}Cr_{15}Mo_{14}C_{15}B_6Y_2$ alloy, and stainless steel under 1M $H_2SO_4$+2 ppm $F^-$ at 75° C. with hydrogen bubbling.

FIG. 3 illustrates potentio-dynamic curves of bipolar plates made of $Fe_{50}Cr_{18}Mo_8A1_2C_{14}B_6Y_2$ and $Fe_{48}Cr_{15}Mo_{14}C_{15}B_6Y_2$ glassy alloys and stainless steel (SS316L) under a 1M $H_2SO_4$+2 ppm $F^-$ environment at 75° C. with hydrogen bubbling.

The corrosion resistance can be expected by the potentio-dynamic curves. However, other factors are relatively important since other factors are applied in a potential that is fixed in a very narrow range and materials are varied depending on a peripheral environment that influences a surface thereof during a corrosion test. The surface modification cannot be instantly done but requires a suitable time. Therefore, the corrosion rate measured on a firstly exposed surface is much greater than that measured on an exposed sample that is in a passivation state for a few hours. The value obtained from a potentio-dynamic experiment is generally greater than the corrosion current density.

Since the $Fe_{50}Cr_{18}Mo_8Al_2C_{14}B_6Y_2$ glassy alloy illustrated in FIG. 3 includes rich Cr at about 18 wt %, it shows good passivation behavior with good corrosion resistance if this glassy alloy is used in the bipolar plate. However, since the $Fe_{48}Cr_{15}Mo_{14}C_{15}B_6Y_2$ glassy alloy includes poor Cr of abut 15 wt %, a passivation region is not distinctly shown.

An Fe-based amorphous alloy with rich Cr such as glassy $Fe_{50}Cr_{18}Mo_8Al_2C_{14}B_6Y_2$ is passivated with a current density of 0.75 mA/cm$^2$ at −0.1V which is a potential value of the PEMFC anode. However, the stainless steel (SS316L) containing the same amount of Cr is in an active passivation transition region showing a current density of 1.1 mA/cm$^2$. This means that stability of the passivation layer of the Fe-based amorphous alloy is greater than that of the stainless steel.

Figure 4:
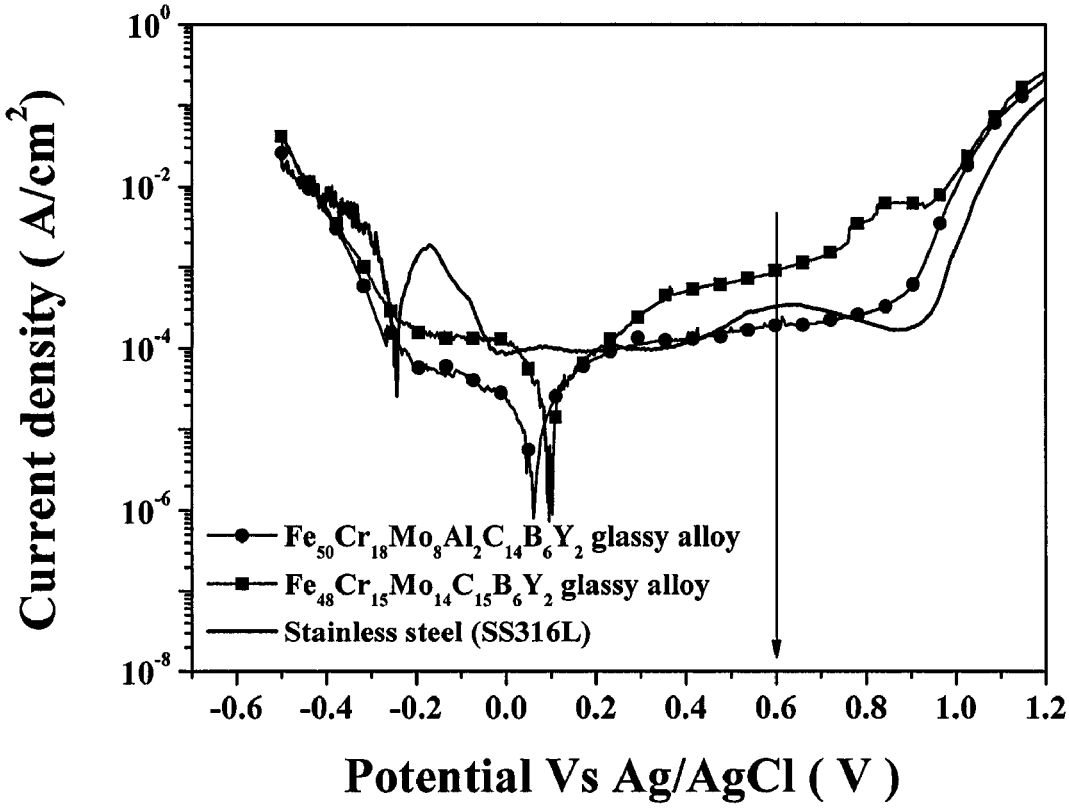
FIG. 4 is a potentio-dynamic graph measuring stainless steel, a $Fe_{50}Cr_{18}Mo_8Al_2C_{14}B_6Y_2$ alloy, and an $Fe_{48}Cr_{15}Mo_{14}C_{15}B_6Y_2$ alloy under 1M $H_2SO_4$+2 ppm $F^-$ at 75° C. with air bubbling.

FIG. 4 illustrates potentio-dynamic curves of bipolar plates made of the $Fe_{50}Cr_{18}Mo_8Al_2C_{14}B_6Y_2$ and $Fe_{48}Cr_{15}Mo_{14}C_{15}B_6Y_2$ glass transition alloys and a stainless steel (SS316L) under 1M $H_2SO_4$ and 2 ppm $F^-$ at 75° C. with air bubbling, respectively.

The Fe-based amorphous alloy including rich Cr such as the $Fe_{50}Cr_{18}Mo_8Al_2C_{14}B_6Y_2$ glass transition shown in FIG. 4 shows a low passivation current density of 78.4 A/cm$^2$ in spite of a distinct passivation region under an air bubbling condition at 75° C. The passivation current density, which is 0.91 mA/cm$^2$, is rather high in the Fe-based amorphous alloy including poor Cr.

The Fe-based amorphous alloy shows higher corrosion resistance under an air supply than under a hydrogen supply. This means that it is advantageous for air including oxygen to form a passivation layer. Inactivity of the corrosion potential of the amorphous alloy under air supply is higher than that under hydrogen supply. That is, the Fe-based amorphous alloy including rich Cr has a corrosion potential of −0.268V under hydrogen supply and 0.062V under air supply. In addition, the Fe-based amorphous alloy including poor Cr has a corrosion potential of −0.201V under hydrogen supply and 0.097V under air supply. This means that corrosion of the amorphous alloy does not often occur under air supply as opposed to under hydrogen supply.

Figure 5:
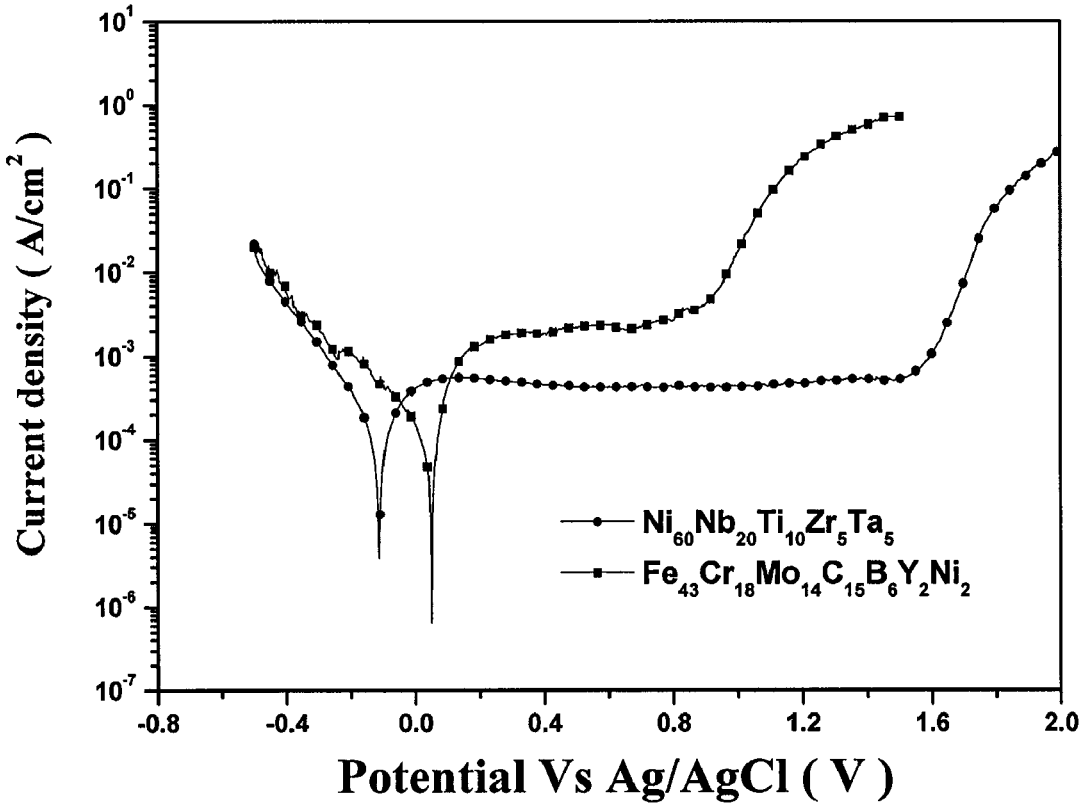
FIG. 5 is a potentio-dynamic graph measuring an $Fe_{43}Cr_{18}Mo_{14}C_{15}B_6Y_2Ni_2$ alloy and a $Ni_{60}Nb_{20}Ti_{10}Zr_5Ta_5$ alloy under 1M $H_2SO_4$+2 ppm $F^-$, at 80° C. with hydrogen bubbling.
Figure 6:
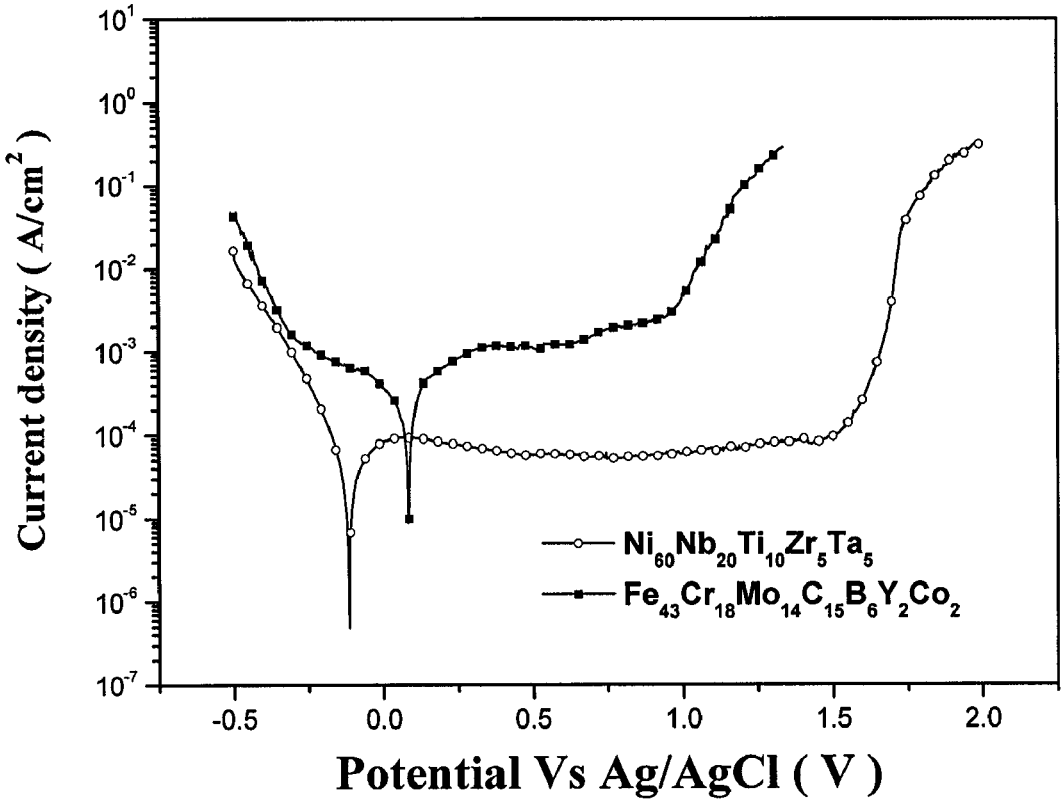
FIG. 6 is a potentio-dynamic graph measuring an $Fe_{43}Cr_{18}Mo_{14}C_{15}B_6Y_2CO_2$ alloy and a $Ni_{60}Nb_{20}Ti_{10}Zr_5Ta_5$ alloy under 1M $H_2SO_4$+2 ppm $F^-$, at 80° C. with air bubbling.

As illustrated in FIGS. 5 and 6, the Ni-based amorphous alloy shows a similar behavior to the Fe-based amorphous alloy since the current density is low when the Ni-based amorphous alloy is used in the PEMFC. The Ni-based amorphous alloy has an advantage that the passivation current density is low and the passivation region is large. Therefore, the Ni-based amorphous alloy can maintain high corrosion resistance regardless of the applied potential.

The aforementioned corrosion resistance deeply relates to ions with passivation of the bipolar plate. The variation of the current density indicates that the oxide layer is passivated. When an X-ray diffraction method (XPS) is carried out, a composition according to the thickness of the oxide film is shown to depend on the environment.

Figure 7:
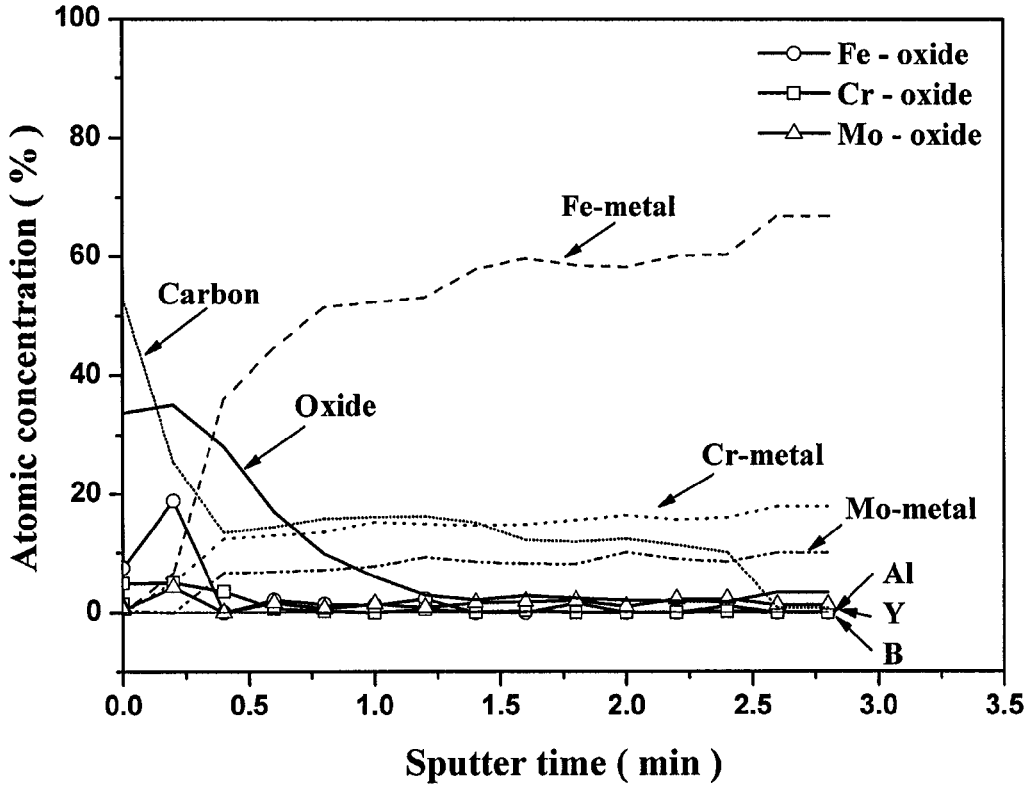
FIG. 7 is a graph illustrating a variation of chemical compositions at a surface of an $Fe_{50}Cr_{18}Mo_8C_{14}B_6Y_2Al_2$ alloy.
Figure 8:
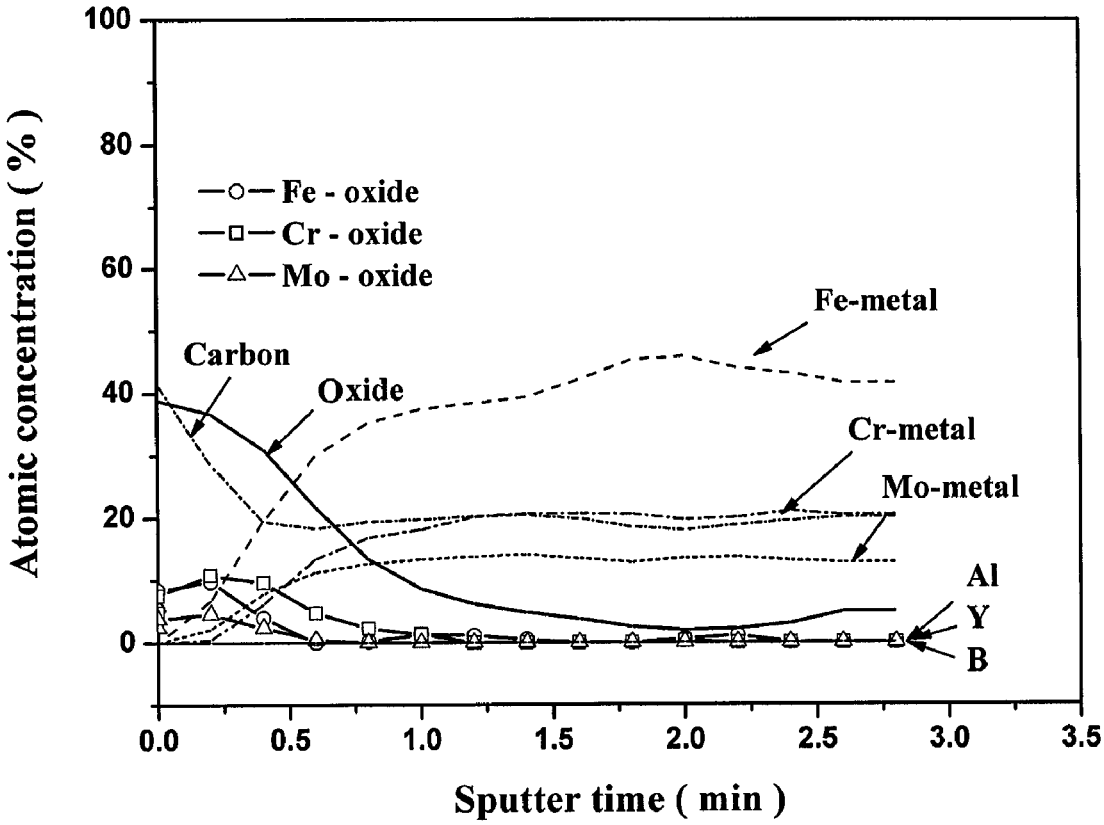
FIG. 8 is a graph illustrating a variation of chemical compositions at a surface of an $Fe_{50}Cr_{18}Mo_8C_{14}B_6Y_2Al_2$ alloy after it is etched under 1M $H_2SO_4$+2 ppm $F^-$, 80° C. with air bubbling.
Figure 9:
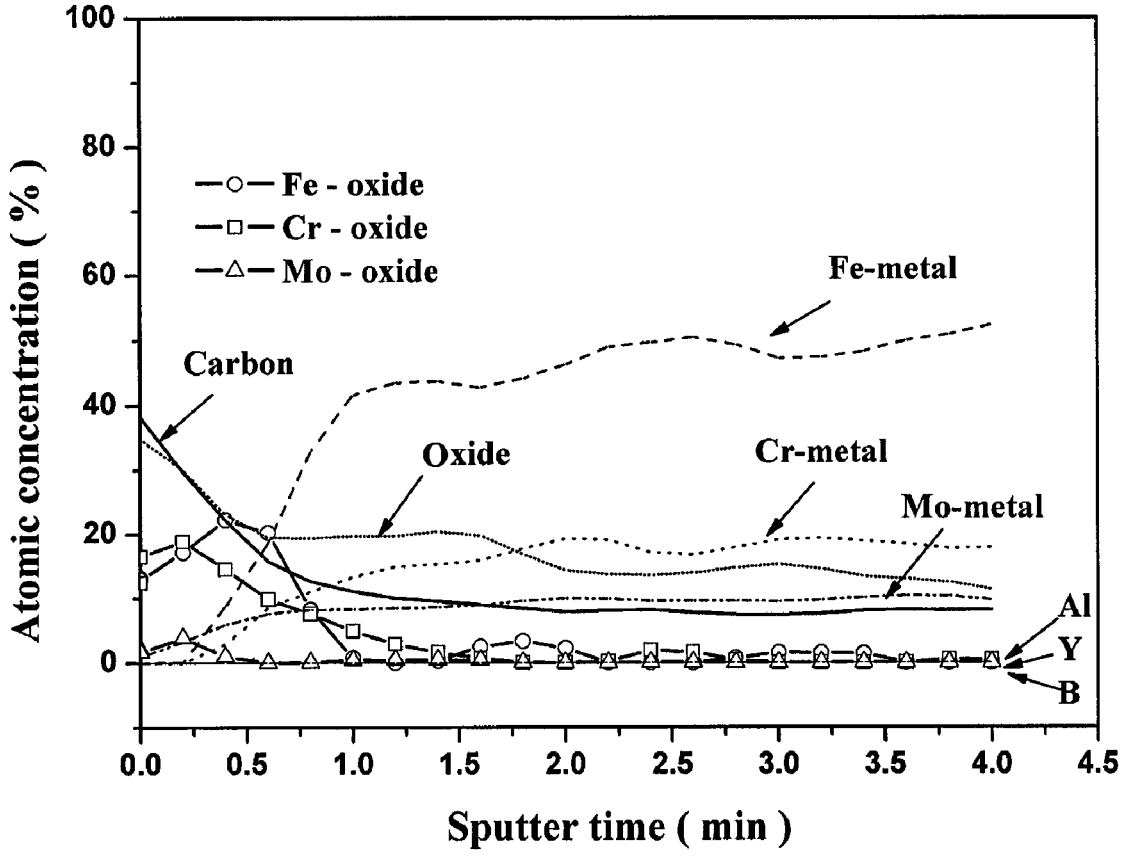
FIG. 9 is a graph illustrating a variation of chemical compositions at a surface of an $Fe_{50}Cr_{18}Mo_8C_{14}B_6Y_2Al_2$ alloy after it is etched under 1M $H_2SO_4$+2 ppm $F^-$, 80° C. with air bubbling.

FIGS. 7 to 9 illustrate the XPS depth profile of the passive film. FIG. 7 illustrates a passive film before the experiment, FIG. 8 illustrates a passive film during a potentiostatic polarization under a PEMFC anode environment, and FIG. 9 illustrates a passive film during a potentiostatic polarization under a PEMFC cathode environment. In the XPS depth profile of the passive film illustrated in FIGS. 7 to 9, the passive film formed during air supply includes an oxide layer containing Fe at about 18 at % and an oxide layer containing Cr at about 5 at %.

A passivation layer is formed on the $SiO_2$ layer with a sputtering rate of 3.5 nm/min. The thickness of the passivation layer formed before experiment, during a potentiostatic polarization under a PEMFC anode environment, and during a potentiostatic polarization under a PEMFC cathode environment is about 2.1 nm, 3.8 nm, and 5.6 nm, respectively. In this case, there is a large difference between the passivation layer formed in the PEMFC environment and the passivation layer under air supply. That is, when an oxide layer including rich Cr is formed with the iron oxide layer, a concentration of Cr oxide increases to two and four times in comparison with the passivation layer under air supply. On the contrary, a concentration of the iron oxide is reduced by two times or there is little change.

As can be known from FIGS. 8 and 9, the thin iron oxide is firstly formed. This is caused by the fact that oxygen diffuses toward the inside and Cr diffuses toward the outside, and thereby a $Cr_2O_3$ protective oxide layer is formed since the iron oxide is formed with a plurality of pores.

The concentration of Mo is constantly maintained at about 4.0 at % in FIGS. 8 and 9. Therefore, the $Fe_{50}Cr_{18}Mo_8Al_2Y_2C_{14}B_6$ amorphous alloy shows high corrosion resistance due to the passive film including Cr in the PEMFC environment by the XPS diffraction analysis. Minor elements such as Al, Co, N, Ni Ti, and V also contribute to formation of the oxide.

Contact Resistance

In a fuel cell, total electric resistance includes the bulk resistances of the bipolar plate and the carbon cloth as well as the interfacial resistance between the bipolar plate and the carbon cloth. Consequently, the contact resistance is more important than the bulk resistance. Contact resistance means a resistance generated in a contact plane that is higher than that of other portions when electric current passes through the contact planes of conductors contacting each other. The contact resistance is varied depending on kinds of conductors, pressure, current density, whether the oxide film exists, etc.

The interfacial contact resistance can be measured by using a set-up condition modified from Davies' method. In the set-up condition, two pieces of conductive carbon paper are sandwiched between the amorphous sample and two copper plates. An electric current is supplied via the two copper plates. The total resistance can be calculated by measuring the total voltage drop as a function of the applied force by using the following equation.

$$R = \frac{VA_s}{I} \qquad \text{Equation 1}$$

Here, R is electric contact resistance, V is the voltage drop during the set-up, I is a supplied current, and $A_s$ is a surface area.

The measured total resistance is a sum of four interfacial components including two resistances at an interface between a carbon paper and a copper plate ($R_{C/Cu}$), the resistance of the carbon paper, and the resistance of the boundary film of the sample interface. Only one layer of the carbon papers sandwiched between the two copper plates is measured in order to correct the interfacial contact resistance ($R_{C/Cu}$) between the copper plate and carbon paper. The measured total resistance can be controlled by forming and using a boundary between the two carbon papers and the copper plate. After the correction, assuming that the surfaces are uniform if a result is divided in half, the interfacial contact resistance ($R_{C/SS}$) between the carbon paper and the stainless steel can be obtained.

Figure 10:
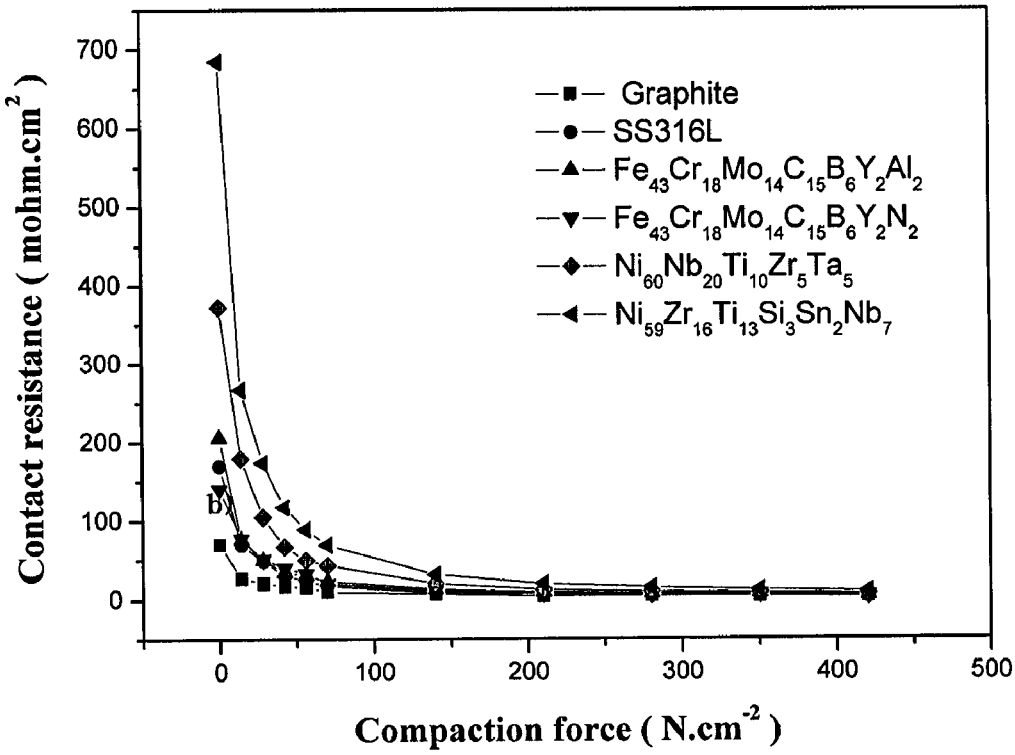
FIGS. 10(A) and 10(B) are graphs illustrating a variation of contact resistance of stainless steel, graphite, and Fe-based and Ni-based amorphous alloys caused by a compaction force.
Figure 10:
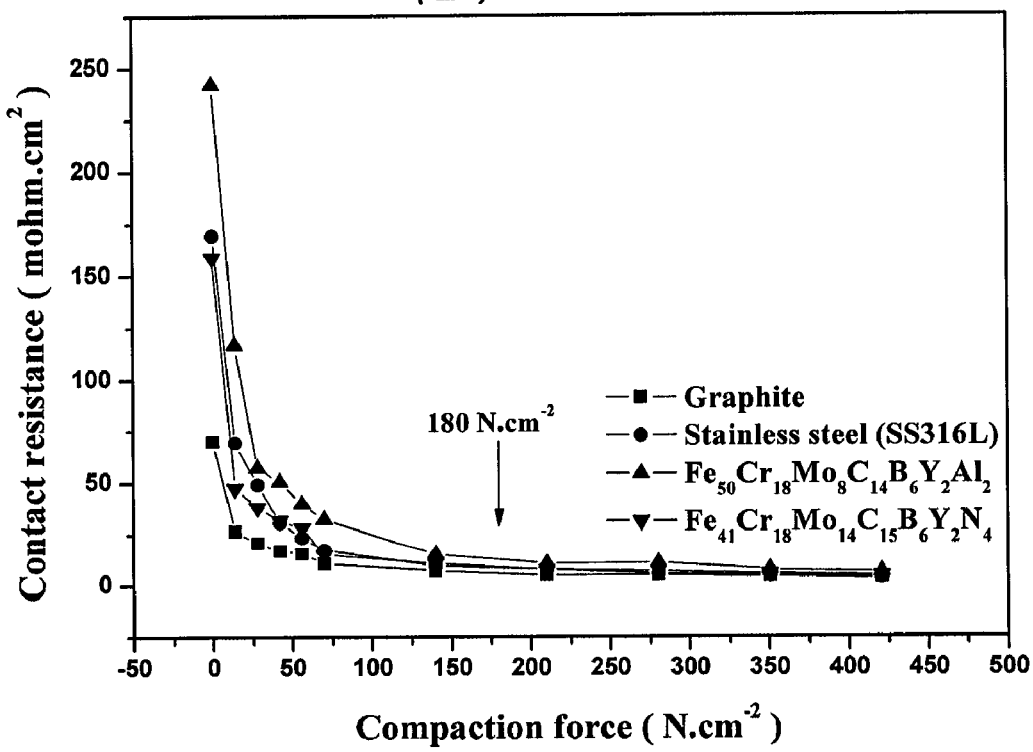

As illustrate in (A) and (B) of FIG. 10, as a compaction pressure is rapidly increased, the contact resistances of the materials are rapidly reduced at low compaction pressures while they are gradually reduced at high compaction pressures. At a given compaction pressure, the contact resistance increases in an order of graphite≦stainless steel≦Fe-based amorphous alloys≦Ni-based amorphous alloys. The contact resistances of graphite, stainless steel (SS316L), an $Fe_{43}Cr_{18}Mo_{14}C_{15}B_6Y_2Al_2$ alloy, an $Fe_{43}Cr_{18}Mo_{14}C_{15}B_6Y_2N_2$ alloy, a $Ni_{59}Zr_{16}Ti_{13}Nb_7Sn_3Si_2$ alloy, and a $Ni_{60}Nb_{20}Ti_{10}Zr_5Ta_5$ alloy are measured to be 5.9 $cm^2$, 8.3 $cm^2$, 10.9 $cm^2$, 12.3 $cm^2$, 15.7 $cm^2$, and 24.9 $cm^2$ under a pressure of 180N/$cm^2$, respectively. The result shows that, even though contact resistance of metallic alloys is higher than that of graphite, the difference between the contact resistance of the Fe-based amorphous alloys and stainless steel is not very large. Therefore, ohmic resistances of a unit cell are similar to each other in the stainless steel and the bipolar plates made of the Fe-based amorphous alloy. However, the Ni-based alloy shows contact resistance that is rather higher than those of the rest of the materials.

Viscosity

Figure 11:
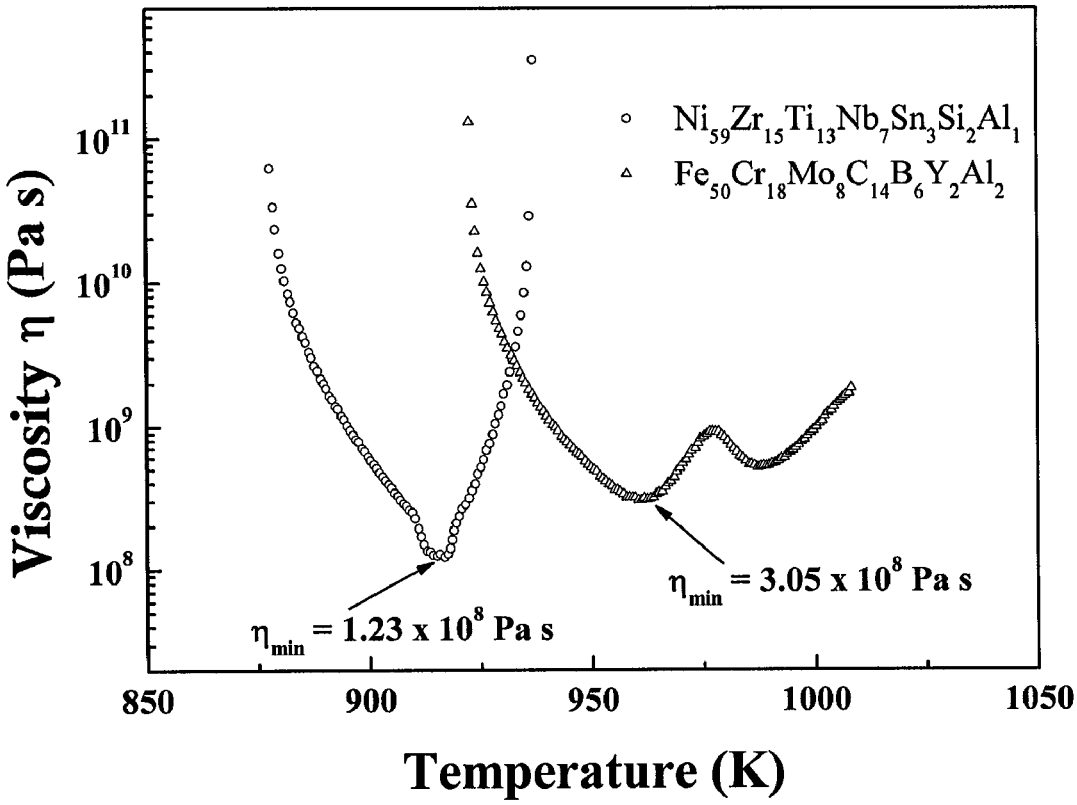
FIG. 11 is a graph illustrating a variation of a viscosity of an $Fe_{43}Cr_{18}Mo_{14}C_{15}B_6Y_2Al_2$ alloy and a $Ni_{59}Zr_{16}Ti_{13}Nb_7Sn_3Si_2$ alloy depending on their temperature.

FIG. 11 illustrates viscosity data of the $Fe_{43}Cr_{18}Mo_{14}C_{15}B_6Y_2Al_2$ alloy and $Ni_{59}Zr_{16}Ti_{13}Nb_7Sn_3Si_2$ alloy. The viscosity is measured by heating the alloys at a rate of 30K/min and applying a load of 250 mN.

As illustrated FIG. 11, although viscosity of the alloy is reduced near the glass transition temperature and in the supercooled liquid area, it increases from the crystallization area. The difference between the glass transition temperature and the crystallization temperature given in Table 1 depends on the difference of heating rate.

The minimum viscosity of the $Fe_{43}Cr_{18}Mo_{14}C_{15}B_6Y_2Al_2$ alloy, the $Fe_{43}Cr_{18}Mo_{14}C_{15}B_6Y_2N_2$ alloy, and the $Ni_{59}Zr_{16}Ti_{13}Nb_7Sn_3Si_2$ alloy is $3\times10^{-8}$ Pa, $5.5\times10^{-8}$ Pa, and $1.2\times10^{-8}$ Pa, respectively. Consequently, it is preferable to form an amorphous alloy at a temperature in which the viscosity is low. However, the higher the temperature, the shorter the time for nucleation of the crystal. Therefore, the time and temperature has to be optimized in order to generate an accurate pattern and avoid nucleation. In addition, the data means that Fe-based and Ni-based amorphous alloys can easily form an amorphous phase due to the large supercooled liquid area.

Figure 12:
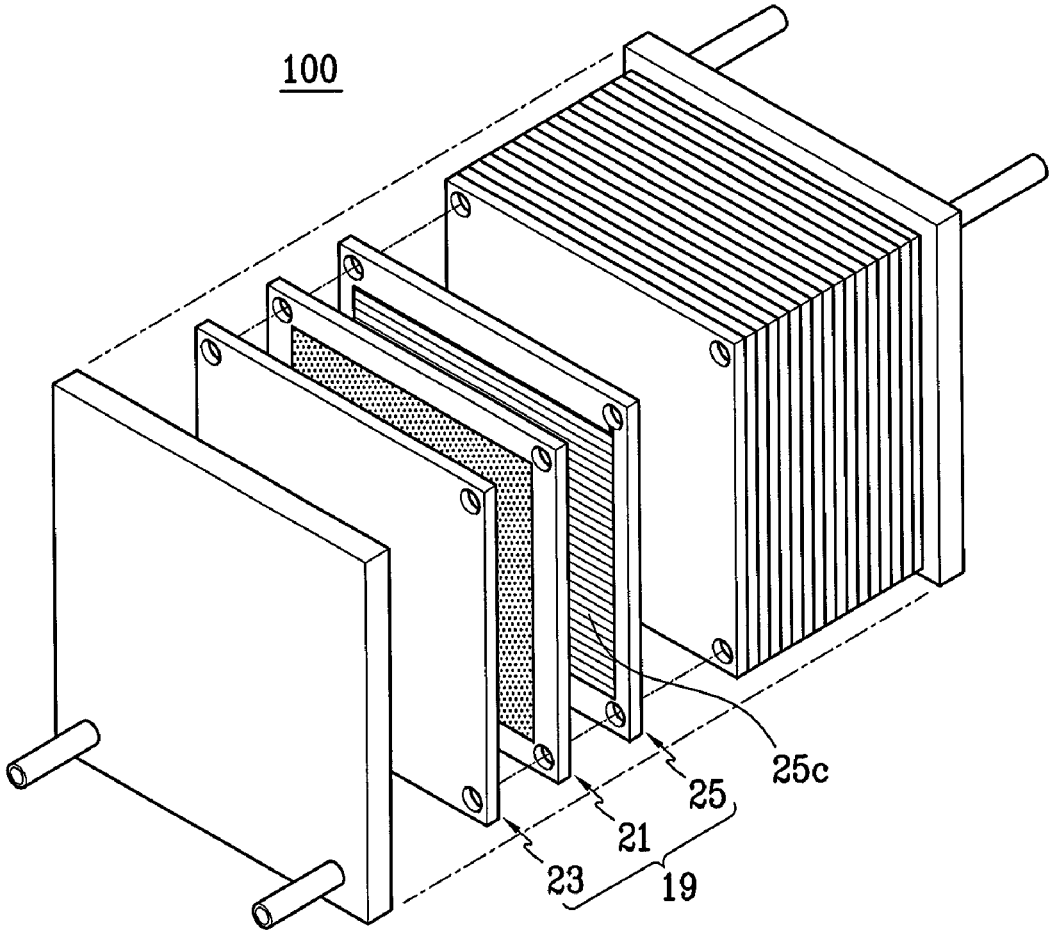
FIG. 12 is a schematic perspective view of a stack of a fuel cell provided with a bipolar plate made of amorphous alloys according to the present invention.

FIG. 12 schematically illustrates a stack 100 of the fuel cell provided with a bipolar plate 25 made of an amorphous metal according to an embodiment of the present invention. The stack 100 of the fuel cell is included in the fuel cell. FIG. 12 illustrates a bipolar plate to which the amorphous alloy of the present invention is applied as an example. However, this is merely to illustrate the present invention and the present invention is not limited thereto. Therefore, the amorphous alloy can be used for other uses.

In the stack 100 of the fuel cell according to an embodiment of the present invention shown in FIG. 12, the MEA 21 is arranged at a center position and bipolar plates 23 and 25 are arranged at both sides of the MEA 21. Therefore, a minimum unit of electricity generating part 19 is formed and electric energy is generated by reaction of hydrogen and oxygen. A plurality of electricity generating parts 19 are continuously arranged, and the stack 100 in which a plurality of electricity generating parts 19 are assembled, can be formed. An anode is formed on one side of the MEA 21 located between the bipolar plates 23 and 25 while a cathode is formed on the other side thereof. An electrolyte membrane is formed between the above two electrodes.

The anode separates hydrogen into hydrogen ions and electrons, and the electrolyte membrane transfers the hydrogen ions to the anode. The electrons and hydrogen ions received from the cathode are reacted with oxygen included in air by the cathode and then water is generated.

The bipolar plates 23 and 25 closely adhere to both sides of the MEA 21. The bipolar plates 23 and 25 act as a conductor that serially connects the anodes and cathodes of the MEA 21. In addition, the bipolar plates 23 and 25 act as a hydrogen passage for supplying hydrogen gas to the anode of the MEA 21 and act as an air passage for supplying air to the anode.

For this, one bipolar plate 23 forms a hydrogen passage for supplying hydrogen to the anode while being closely arranged on the anode of the MEA 21. In addition, the other bipolar plate 25 forms an air passage for supplying air to the cathode of the MEA 21 while being closely arranged on the cathode of the MEA 21. The hydrogen passage is formed to include a hydrogen transferring channel 23*c* that is formed on a closely adhering side of one bipolar plate 23 facing the MEA 21. In addition, an air passage is formed to include an air transferring channel (not shown) that is formed on a closely adhering side of the other bipolar plate 25 facing the MEA 21.

The bipolar plates 23 and 25 are manufactured using amorphous alloys according to an embodiment of the present invention. As described above, since the bipolar plates 23 and 25 act as hydrogen and air passages, the bipolar plates 23 and 25 should have good corrosion resistance if they are made of a metal. According to the present invention, since the bipolar plates 23 and 25 are manufactured by using the amorphous alloy, there is no possibility that the bipolar plates 23 and 25 will be corroded. The amorphous alloy will be explained in detail below.

The present invention will be explained with reference to the experimental examples of the present invention below. The experimental examples are merely to illustrate the present invention and the present invention is not limited thereto.

Test of Amorphous Structure and Mechanical Properties of Amorphous Alloys

Physical properties of the bipolar plates made of the Fe-based and Ni-based amorphous alloys were measured. The test was performed on six Fe-based amorphous alloys and two Ni-based amorphous alloys. The glass transition temperature ($T_g$), crystallization temperature ($T_x$), Vickers microhardness (Hv), and compression strength ($\sigma_f$) are described in Table 1.

TABLE 1

| | Alloy composition | $T_g$(° C.) | $T_x$(° C.) | $H_v$(kgf/mm$^2$) | $\sigma_f$(MPa) |
|---|---|---|---|---|---|
| Fe-based | $Fe_{48}Cr_{15}Mo_{14}C_{15}B_6Y_2$ | 575 | 612 | — | — |
| | $Fe_{45}Cr_{18}Mo_{14}C_{15}B_6Y_2$ | 599 | 625 | 1132 | 2781 |
| | $Fe_{43}Cr_{18}Mo_{14}C_{15}B_6Y_2Al_2$ | 626 | 640 | 1192 | — |
| | $Fe_{43}Cr_{18}Mo_{14}C_{15}B_6Y_2Co_2$ | 596 | 626 | 1024 | 3684 |
| | $Fe_{43}Cr_{18}Mo_{14}C_{15}B_6Y_2N_2$ | 590 | 624 | 1187 | 3919 |
| | $Fe_{43}Cr_{18}Mo_{14}C_{15}B_6Y_2Ni_2$ | 596 | 620 | 1121 | 2972 |
| Ni-based | $Ni_{59}Zr_{16}Ti_{13}Nb_7Sn_3Si_2$ | 553 | 607 | | 3015 |
| | $Ni_{60}Nb_{20}Ti_{10}Zr_5Ta_5$ | 581 | 623 | — | — |

As described in Table 1, both the Fe-based and Ni-based amorphous alloys have $T_g$ and $T_x$. This means that the Fe-based and Ni-based amorphous alloys can be used at a high temperature without modifying microstructures. In addition, these amorphous alloys have microhardness of over 1000 kgf/mm$^2$ and high strength in a range from 2500 MPa and 4000 MPa. Materials with the above microhardness and strength are suitable for using in an operation environment of bipolar plates.

Potentio-Dynamic Experiments of the Amorphous Alloy

Figure 13:
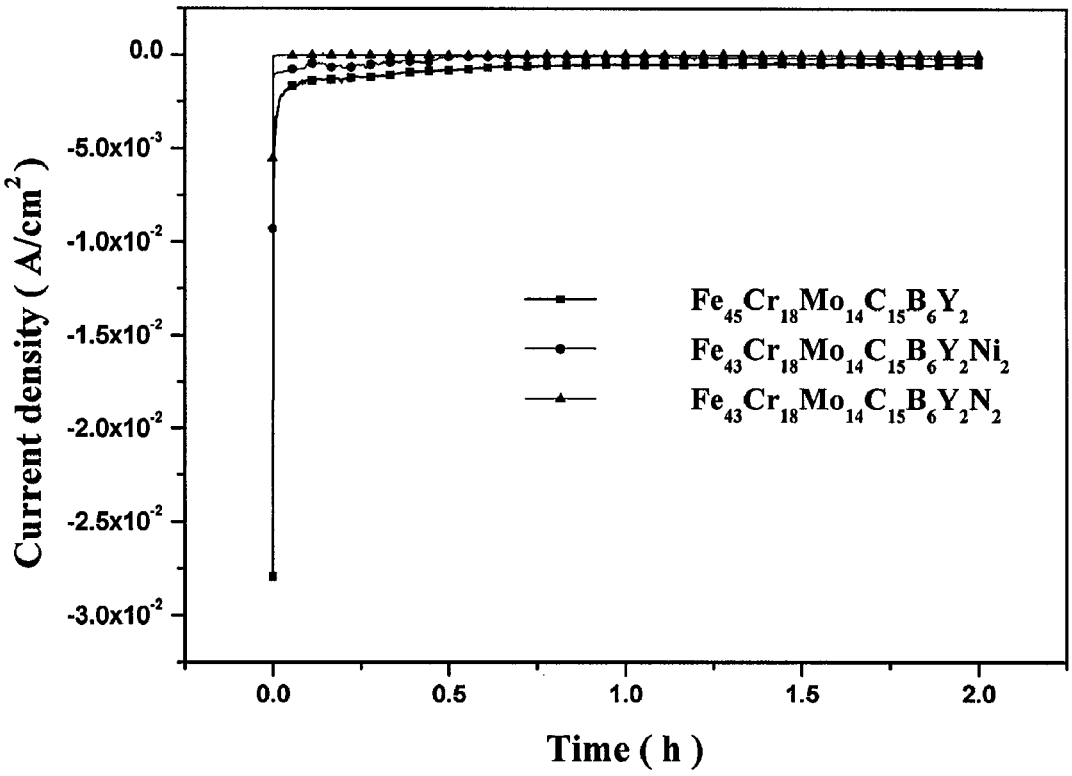
FIG. 13 is a graph illustrating a current density variation of $Fe_{45-x}Cr_{18}Mo_{14}C_{15}B_6Y_2M_x$ alloys under 1M $H_2SO_4$+2 ppm $F^-$, 80° C. with hydrogen bubbling at a cathode.
Figure 14:
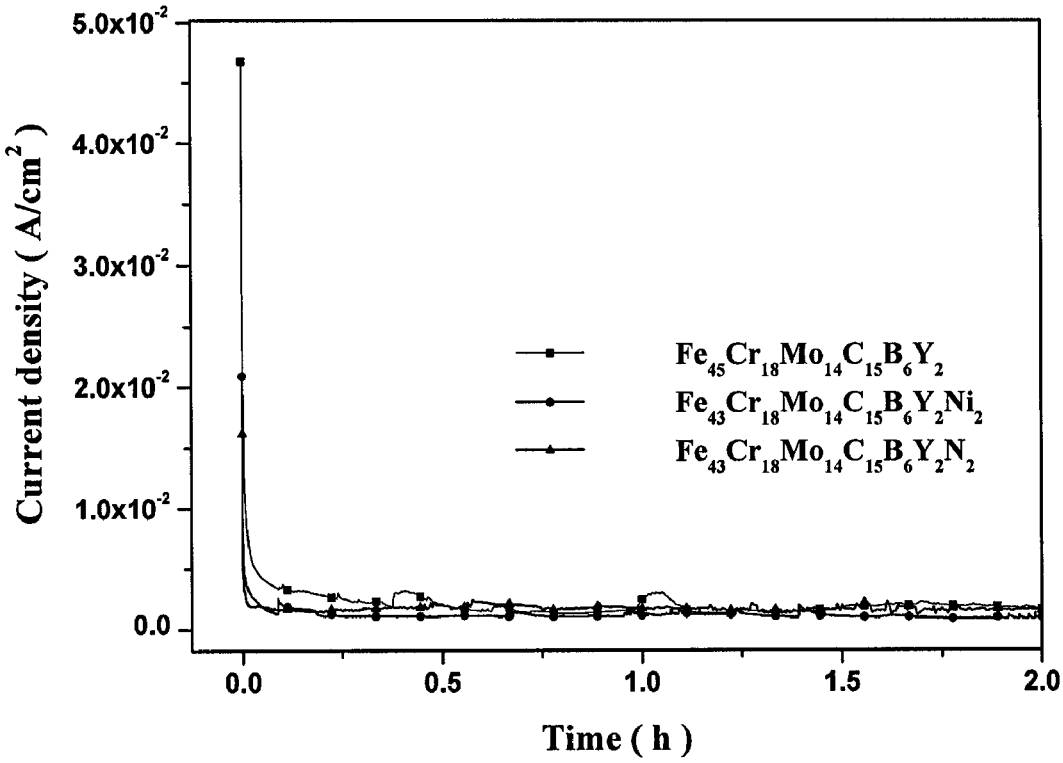
FIG. 14 is a graph illustrating a current density variation of $Fe_{45-x}Cr_{18}Mo_{14}C_{15}B_6Y_2M_x$ alloys under 1M $H_2SO_4$+2 ppm $F^-$, 80° C. with air bubbling at an anode.

Potentio-dynamic experiments were carried out on five Fe-based amorphous alloys, two Ni-based amorphous alloys, and stainless steel (SS316L) under 1M $H_2SO_4$+2 ppm $F^-$ at 80° C. with hydrogen bubbling and air bubbling. Corrosion potentials and corrosion currents according to the potentio-dynamic experiments are described in Table 2. FIG. 13 illustrates $Fe_{45}Cr_{18}Mo_{14}C_{15}B_6Y_2$, $Fe_{43}Cr_{18}Mo_{14}C_{15}B_6Y_2Ni_2$, and $Fe_{43}Cr_{18}Mo_{14}C_{15}B_6Y_2N_2$ included in the Fe-based amorphous alloy under a hydrogen supplying condition while FIG. 14 illustrates them under an air supplying condition.

TABLE 2

| | | Corrosion current density (mA) | | Corrosion potential (V) | | Passivation current (mA) | |
|---|---|---|---|---|---|---|---|
| | Alloy composition | $H_2$ | air | $H_2$ | air | $H_2$ | air |
| Fe-based | $Fe_{45}Cr_{18}Mo_{14}C_{15}B_6Y_2$ | 0.68 | 0.38 | 0.08 | 0.094 | 0.76 | 4.14 |
| | $Fe_{43}Cr_{18}Mo_{14}C_{15}B_6Y_2Al_2$ | 0.11 | 0.09 | −0.232 | 0.048 | 0.79 | 2.13 |
| | $Fe_{43}Cr_{18}Mo_{14}C_{15}B_6Y_2Co_2$ | 1.34 | 0.53 | 0.072 | 0.085 | 0.79 | 1.3 |
| | $Fe_{43}Cr_{18}Mo_{14}C_{15}B_6Y_2N_2$ | 0.43 | 0.016 | 0.046 | 0.011 | 0.79 | 1.0 |
| | $Fe_{43}Cr_{18}Mo_{14}C_{15}B_6Y_2Ni_2$ | 0.57 | 0.024 | 0.05 | 0.013 | 0.42 | 1.4 |

TABLE 2-continued

| | Alloy composition | Corrosion current density (mA) | | Corrosion potential (V) | | Passivation current (mA) | |
|---|---|---|---|---|---|---|---|
| | | $H_2$ | air | $H_2$ | air | $H_2$ | air |
| Ni-based | $Ni_{59}Zr_{16}Ti_{13}Nb_7Sn_3Si_2$ | 0.112 | 0.009 | −0.231 | −0.143 | 0.68 | 0.657 |
| | $Ni_{60}Nb_{20}Ti_{10}Zr_5Ta_5$ | 0.235 | 0.036 | −0.113 | −0.115 | 0.0697 | 0.066 |
| SUS-316L | Fe-16.8Cr-10.3Ni-2.25Mo-1.95Mn-0.65Si-0.04N-0.5Cu-0.5Co (in wt %) | 1.51 | 3.26 | −0.242 | −0.221 | 0.99 | 1.4 |

As illustrated in FIG. 13, when a constant voltage of −0.1V was applied to the amorphous alloy, the current density was negative and increased rapidly at the first step of polarization and then stabilized to reach very low values after about 30 minutes. The negative current indicates that the passive layer is protected by the cathode, which means that there is no active dissolution at the anode of polymer electrolytic fuel cells.

Similar behavior occurred when a constant voltage of 0.6V was applied to the amorphous alloy based on a cathode condition made of the amorphous alloy. In this case, the current density was positive and quickly decreased to a stabilized value in a short time. The current drop from $5\times10^{-2}$A/cm$^2$ at the beginning of the experiment to 1 mA/cm$^2$ after 1 hour of the polarization test was caused by formation of a passive layer. As the passive layer is formed on the entire surface, the current required for maintaining the passive layer is reduced. The fact that the current becomes constant after one hour means that the passive film formed on the Fe-based amorphous alloys is stable.

The potentio-dynamic curves shown in FIGS. 13 and 14 relatively illustrate a potential of −0.1V with hydrogen bubbling and a potential of 0.6V with air bubbling, respectively. The initially negative current density at the anode increased to reach almost zero with hydrogen bubbling. On the other hand, the current density at the cathode quickly decreased from the initial value indicating formation of a passive layer on a surface of the amorphous alloy with air bubbling.

Referring to FIGS. 13 and 14, Ni shows good corrosion resistance with air bubbling while N shows good corrosion resistance with hydrogen bubbling. In addition, if the corrosion current density and corrosion potential of the amorphous alloy is compared with stainless steel (SS316L), it can be seen that corrosion resistance of the Fe-based amorphous alloy is high. The Ni-based amorphous alloy shows the same result.

In addition, referring to FIGS. 13 and 14, among the Fe-based amorphous alloy, the $Fe_{43}Cr_{18}Mo_{14}C_{15}B_6Y_2N_2$ alloy has the most excellent corrosion resistance and contact resistance. Therefore, since characteristics of the amorphous alloy are improved when N is added to the amorphous alloy, it is suitable for use in the bipolar plate. There is an advantage that current flows well if N is mixed in an oxide layer formed on a surface of the amorphous alloy.

Meanwhile, as illustrated in Table 3 below, the initial and final values of the current density were varied depending on other characteristics and thickness of the oxide layer.

TABLE 3

| | Alloy composition | Charge density (Q) coul/cm$^2$ | |
|---|---|---|---|
| | | $H_2$ | air |
| Fe-based | $Fe_{45}Cr_{18}Mo_{14}C_{15}B_6Y_2$ | −5.148 | 15.07 |
| | $Fe_{43}Cr_{18}Mo_{14}C_{15}B_6Y_2Al_2$ | −0.22 | 13.64 |
| | $Fe_{43}Cr_{18}Mo_{14}C_{15}B_6Y_2N_2$ | −0.0687 | 12.35 |
| | $Fe_{43}Cr_{18}Mo_{14}C_{15}B_6Y_2Ni_2$ | −1.66 | 8.43 |

Corrosion Tests

A solution was analyzed after the corrosion test was performed to the alloy. An ICP-AA method, which is more direct and reliable than a potentio-static method or a potentio-dynamic method, was used to evaluate corrosion solutions of the Fe—Cr—Mo—Al—C—B—Y amorphous alloy. As described in Table 4 below, the amount of Cr, which is an element for dissolving under a hydrogen atmosphere and forming passivation, is greater than that contained in the PEMFC including air bubbles. This means that a reaction is very active during hydrogen supply rather than during air supply, which corresponded to a result of the potentio-dynamic experiment.

The corrosion resistance of the material was directly measured by using corrosion current density. The equivalent corrosion current density ($I_{corr\text{-}S}$) was calculated by averaging the charge density obtained from a solution analysis ($Q_S$) described in Table 4 below. The corrosion current density ($I_{corr\text{-}P}$=0.197 mA/cm$^2$) was measured by applying the Tafel slope to the potentio-dynamic curves for comparison.

The corrosion current density ($I_{corr\text{-}S}$) by the electrolysis was very low under hydrogen bubbling. In addition, a slightly higher corrosion rate was observed at the potentio-dynamic test ($I_{corr\text{-}P}$). In fact, the potentio-dynamic tests were performed for a shorter time. This means that sufficient time was not given for forming a passive film. However, these corrosion data already provide useful information regarding corrosion behavior. $I_{corr\text{-}S}$ described in Table 4 are the same as $I_{corr\text{-}P}$ (=0.015 mA/cm$^2$) under air bubbling. This means that the passive layer was rapidly stabilized. By comparing the $I_{corr\text{-}S}$ with the $I_{corr\text{-}P}$, it could be observed that the amorphous alloy had a lower corrosion current density than the stainless steel. This means that the amorphous alloy has better corrosion resistance than that of stainless steel. This result means that the Fe-based amorphous alloy according to the present invention can be used as a material of the bipolar plate of the PEMFC.

TABLE 4

| Alloy constitutive elements | | Dissolved species analyzed by ICP-AA (mg/l) | |
|---|---|---|---|
| | | $H_2$ bubbled | Air bubbled |
| $Fe_{50}Cr_{18}Mo_8C_{14}B_6Y_2Al_2$ | Fe | 1.09 | 2.72 |
| | Cr | 0.6 | 0.29 |
| | Mo | 0.05 | 0.38 |
| | B | 0.091 | 0.12 |
| | Y | 2.16 | 0.66 |
| | Al | 0.23 | 0.25 |
| Charge density ($Q_S$) | $C/cm^2$ | 0.179 | 0.242 |
| Corrosion current density ($I_{corr-S}$) | $mA/cm^2$ | 0.00995 | 0.01344 |

Contact Resistance Test

Contact resistance tests were performed on the amorphous alloys. The interfacial contact resistance of amorphous alloys was measured using a set-up modification from Davies' method while applying forces having different values and was compared with values obtained from graphite and stainless steel (SS316L). Two pieces of carbon paper were sandwiched between the amorphous alloy specimen and two copper plates. The interfacial contact resistance between fresh samples of the different plates made of an amorphous alloy, stainless steel, and carbon paper was measured depending on different applied forces. With increasing compaction pressure, the contact resistance of the materials rapidly decreased at low compaction pressure and then gradually decreased at high compaction pressure.

For example, the contact resistance increased in an order of graphite≦stainless steel≦Fe-based amorphous alloy≦Ni-based amorphous alloy when compaction pressure of 180N/$cm^2$ was applied as in Table 5 below.

TABLE 5

| | Alloy composition | Contact resistance ($m/cm^2$) at 180N/$cm^2$ compaction force |
|---|---|---|
| Fe-based | $Fe_{43}Cr_{18}Mo_{14}C_{15}B_6Y_2Al_2$ | 11 |
| | $Fe_{43}Cr_{18}Mo_{14}C_{15}B_6Y_2N_2$ | 9.5 |
| | $Fe_{44}Cr_{15}Mo_{14}C_{15}B_6Y_2N_4$ | 8.0 |
| Ni-based | $Ni_{59}Zr_{16}Ti_{13}Nb_7Sn_3Si_2$ | 15.5 |
| | $Ni_{60}Nb_{20}Ti_{10}Zr_5Ta_5$ | 25 |

As shown in Table 5, the contact resistance of the Fe-based amorphous alloy was almost equal to that of the stainless steel. On the contrary, the Ni-based amorphous alloy had a slightly higher contact resistance. Therefore, the amorphous alloy according to the present invention can also be used in an ocean environment as well as in the bipolar plate.

Surface Energy Experiment of the Amorphous Alloy

Surface energies of the amorphous alloys were measured. The material of the bipolar plate should have characteristics of low water absorption, sufficient mechanical strength, low weight, and chemical stability in the electrolyte membrane fuel cell environment as well as the above characteristics. The water absorption at a cathode of the bipolar plate depends on the wettability of the material. In addition, it affects the performance of the cell. The surface energy of the amorphous alloy including Al and N can be obtained by measuring the wetting angle (θ) and is given in Table 6. The wetting angle was higher than that of stainless steel) (76°, and was lower than that of graphite)(104°). That is, wetting angle is in a range from 80° to 100°. This means that the surface energy of the amorphous alloy to water is lower than that of the stainless steel (SS316L). Therefore, it can be predicted that water generated in the PEMFC can flow and be removed when it contacts the amorphous alloy.

TABLE 6

| NO | Materials | Wetting angle (θ)(°) |
|---|---|---|
| 1 | Graphite | 104 |
| 2 | stainless steel (SS316L) | 76 |
| 3 | $Fe_{50}Cr_{18}Mo_8Al_2Y_2C_{14}B_6$ | 92 |
| 4 | $Fe_{41}Cr_{18}Mo_{14}Y_2C_{14}N_6$ | 88 |

Although exemplary embodiments of the present invention have been described in detail hereinabove, it should be clearly understood that many variations and/or modifications of the basic inventive concept herein taught, which may appear to those skilled in the art, will still fall within the spirit and scope of the present invention as defined in the appended claims.

What is claimed is:

1. An amorphous alloy having a chemical formula of $Fe_{100-a-b-c-d-e-f-g-h}Cr_aMo_bC_cB_dY_eM_fI_gN_h$, wherein the M is at least one selected from a group consisting of Al, Co, and Ni, wherein the I is at least one selected from a group consisting of Mn, P, S, and O as impurities, and wherein the a, b, c, d, e, f, g, and h are satisfied with the compositions of 16.0 wt %≦a≦22.0 wt %, 15.0 wt %≦b≦27.0 wt %, 2.0 wt %≦c≦3.5 wt %, 1.0 wt %≦d≦1.5 wt %, 1.0 wt %≦e≦3.5 wt %, 0 wt %≦f≦2.6 wt %, 0 wt %≦g≦0.5 wt %, and 0.4 wt %≦h≦1.0 wt % respectively.

2. The amorphous alloy of claim 1, wherein the N is substantially 0.8 wt %.

3. The amorphous alloy of claim 1, wherein an oxide film is formed on a surface of the amorphous alloy, and the oxide film comprises the N.

4. The amorphous alloy of claim 1, wherein the Vickers microhardness of the amorphous alloy is 1000 kgf/$mm^2$ or more, and the compression strength of the amorphous alloy is in a range from 2500 MPa to 4000 MPa.

5. The amorphous alloy of claim 1, wherein a wetting angle of the amorphous alloy is in a range from 80° to 100°.

6. The amorphous alloy of claim 1, wherein the amorphous alloy is used as a material for a bipolar plate of a fuel cell.

* * * * *